United States Patent [19]

Aszman et al.

[11] Patent Number: 4,501,680

[45] Date of Patent: Feb. 26, 1985

[54] ACIDIC LIQUID DETERGENT COMPOSITION FOR CLEANING CERAMIC TILES WITHOUT ERODING GROUT

[75] Inventors: Harry W. Aszman, Spotswood; Charles E. Buck, Caldwell; Cherie H. Everhart, Califon, all of N.J.

[73] Assignee: Colgate-Palmolive Company, New York, N.Y.

[21] Appl. No.: 550,247

[22] Filed: Nov. 9, 1983

[51] Int. Cl.[3] ..... C11D 7/08

[52] U.S. Cl. ..... 252/142; 252/136; 252/86; 252/173; 252/180; 252/DIG. 10; 252/DIG. 11; 252/DIG. 14; 134/3; 134/28

[58] Field of Search ..... 252/136, 142, 143, 86, 252/87, 79.4, 174.21, 173, DIG. 10, DIG. 11, DIG. 14, 178, 179, 180, 181; 134/3, 28

[56] References Cited

U.S. PATENT DOCUMENTS

| | | | |
|---|---|---|---|
| 1,897,813 | 2/1933 | Mougey | 252/136 |
| 2,493,327 | 1/1950 | Vance | 148/6.15 |
| 2,558,167 | 6/1951 | Beghin et al. | 252/136 |
| 2,585,127 | 2/1952 | Holman et al. | 252/136 |
| 2,593,259 | 4/1952 | Brissey et al. | 252/136 |
| 2,687,346 | 8/1954 | McDonald | 41/42 |
| 2,878,188 | 3/1959 | Callahan | 252/DIG. 10 |
| 3,162,547 | 12/1964 | Kendall | 134/3 |
| 3,211,659 | 10/1965 | Pikaar | 252/142 |
| 3,507,798 | 4/1970 | Egan et al. | 252/135 |
| 3,650,965 | 3/1972 | Cantor et al. | 252/106 |
| 3,909,437 | 9/1975 | Alexander et al. | 252/143 |
| 3,915,633 | 10/1975 | Ramachandran | 8/137 |
| 3,941,713 | 3/1976 | Dawson et al. | 252/142 |
| 3,953,352 | 4/1976 | Mizutani et al. | 252/142 |
| 4,032,466 | 6/1977 | Otrhalek et al. | 252/136 |
| 4,181,622 | 1/1980 | Gavin | 252/143 |
| 4,181,623 | 1/1980 | Dillarstone et al. | 134/3 |
| 4,210,550 | 7/1980 | Cornelissens | 252/180 |
| 4,239,552 | 12/1980 | Perner et al. | 252/142 |
| 4,247,408 | 1/1981 | Imamura et al. | 252/143 |
| 4,416,794 | 11/1983 | Barrat et al. | 252/DIG. 14 |

FOREIGN PATENT DOCUMENTS

| | | |
|---|---|---|
| 135252 | 4/1913 | Japan . |
| 77111 | 6/1977 | Japan . |
| 28199 | 2/1982 | Japan . |
| 61096 | 4/1982 | Japan . |

OTHER PUBLICATIONS

The Chemical Formulary by Bennett, p. 233 (1971).

*Primary Examiner*—Paul Lieberman
*Assistant Examiner*—Hoa Van Le
*Attorney, Agent, or Firm*—Richard N. Miller; Murray M. Grill; Herbert S. Sylvester

[57] ABSTRACT

An acidic liquid detergent composition for cleaning ceramic tiles without eroding the grout between the tiles comprises minor proportions of partially neutralized glutaric acid, partially neutralized phosphoric acid, surface active condensation product of ethylene oxide and higher linear alcohol of 10 to 20 carbon atoms, such as the condensation product of a linear secondary alcohol averaging about 13 carbon atoms with about 20 moles of ethylene oxide, and mono-lower alkyl ether of diethylene glycol, such as the butyl ether of diethylene glycol, and a major proportion of water, with the pH of the composition being within the range of 3 to 5, preferably 4.0. The composition is found to be an excellent bathroom cleaner, being especially useful for cleaning soap scum and other soil from ceramic tile, porcelain ware, such as bathtubs and sinks, and from other hard surfaces. Tile cleaning is easily effected without erosion of the grout between the tiles, which is often experienced when other acidic cleaners are utilized. Within broader composition aspects of the invention are acidic cleaning compositions containing glutaric acid or a salt thereof, together with an acid or salt thereof, the calcium salt of which is water insoluble. Also within the invention are methods for manufacturing the described liquid detergent compositions and methods of cleaning ceramic tiles and intermediate grout without causing erosion of the grout.

14 Claims, No Drawings

ACIDIC LIQUID DETERGENT COMPOSITION FOR CLEANING CERAMIC TILES WITHOUT ERODING GROUT

This application relates to detergent compositions. More particularly, it relates to acidic liquid detergent compositions which are useful for cleaning hard surfaces, especially for cleaning ceramic tiles to remove soap scum from them without eroding of grout between such tiles.

The problem of cleaning soap scum from bathroom surfaces, such as sinks, tubs, shower walls and floors, and ceramic tile walls and floors, is one that is well known to every householder. Soap scum, which contains water insoluble calcium and magnesium soaps, produced by the reactions of hard water on soluble sodium soaps, causes dulling and streaking of tile and other hard surfaces, which are normally and desirably attractively lustrous and shiny. Such soap scum is usually strongly adherent to the substrate and is difficult to remove with the aid of conventional cleaning materials.

It is known that acids and acidic preparations help to remove soap scum from tiles, and acidic cleaners have been made, patented and marketed. Synthetic detergents have been used in tile cleaners and solvents have also been employed in them. The liquid form of such cleaners is often preferred and water is often the carrier or solvent of choice. The problem of adequately and easily removing soap scum from ceramic tiles has been known for a long time and water, detergents, acidifying agents and solvents have been suggested for inclusion in tile cleaning compositions. Still, before the present invention cleaning compositions were not available which were useful for effectively cleaning ceramic tiles and porcelain ware without damaging the grout between such tiles or adjacent to the porcelain. Such grout, which may be of the latex or Portland cement type, normally includes a major proportion of calcium carbonate. Calcium carbonate reacts with acid and therefore the use of acidic cleaners has in the past caused erosion of the grout so that after repeated uses it would become non-adherent and would crack and disintegrate, causing leakage, and eventually requiring replacement. The compositions of the present invention clean the tile without harming the grout and thus they avoid this serious problem that is associated with other acidic cleaners. The cleaning of the tiles by the present compositions is easily effected and in most cases the cleaned tile sparkles and soon recovers its original attractive luster.

A search in the classified patent files of the United States Patent and Trademark Office has revealed a number of references of different degrees of relevance to the present invention. Among the U.S. patents found are U.S. Pat. No's. 1,897,813; 2,493,327; 2,558,167; 2,585,127; 2,593,259; 2,629,626; 2,687,346; 3,162,547; 3,211,659; 3,507,798; 3,650,965; 3,909,437; 3,915,633; 3,953,352; 4,032,466; 4,181,622; 4,235,734; and 4,247,408. Of these a few of the more relevant disclosures will be discussed specifically below.

U.S. Pat. No. 3,650,965 describes a low foaming detergent composition which comprises a mixture of two nonionic surface active components, one having a cloud point above 45° C. and the other having a cloud point below 35° C., an aliphatic monocarboxylic acid, butyl Cellosolve and a mineral acid, such as phosphoric acid. U.S. Pat. No. 4,032,466 described a thickened acid cleaner concentrate which comprises an inorganic acid, an organic acid, a nonionic surfactant, an anionic surfactant, a flocculating agent, such as iron or aluminum ion, and water. This product is intended for cleaning vehicles, such as railroad equipment. U.S. Pat. No. 4,235,734 discloses an acidic bathroom cleaning composition containing butyl Carbitol, nonionic or cationic detergent, inorganic or organic acid and water, useful for cleaning ferrous surfaces. U.S. Pat. No. 4,247,408 is for a weakly acidic liquid detergent composition which contains a water soluble solvent which is an ether of a polymer of lower alkylene oxides, a surface active agent or a mixture thereof, a water soluble acidic substance or a mixture of such substance and a water soluble salt thereof, and water. The product described is said to be useful for cleaning hard surfaces, such as bathroom surfaces, for example, toilets.

In addition to the mentioned U.S. patents, several Japanese patents of interest have been noted. Japanese Pat. No. 77,111 (1977) describes a bathroom composition which contains one or more types of organic acids and an alkyl, phenyl or benzyl ether or ethylene glycol, diethylene glycol or triethylene glycol. It is taught that the compositions of the patent, which may include acidic substances, surfactant, water soluble solvent and water, are useful for removing stains from bathroom surfaces. However, neither glutaric acid nor partially neutralized salts thereof are mentioned. Japanese Pat. No. 28,199 (1982) describes a liquid detergent composition which includes an acidic substance, a surfactant and a water soluble solvent, such as 3-methyl-3-methoxy butanol. Although glutaric acid is not mentioned in a listing of suitable acids in the body of the specification, it is described as a component of a mixture of three acids in Example 2 of the patent. The products of the invention are said to be useful in removing stains adhered to a bath bucket and a lavatory, and the liquid detergent composition is said to be low in toxicity and not to produce unpleasant odors. Japanese patent application No. 135,252 (1980) is for a detergent for use in cleaning bathrooms and is particularly directed to removing from bathroom surfaces organic and inorganic substances, such as calcium soaps, free fatty acids, glycerides and compounds containing nitrogen. The invention is said to be an improvement over a previous invention of the same inventors, in which nonionic surface active agents, hydroxypolycarboxylic acids or their salts, and polypropylene glycol were specified. In the improvement invention ethylene glycol or polyethylene glycol replaces part of the polypropylene glycol and the result is improved resistance to freezing and to freeze-thaw deterioration of the product. Although various organic acids are mentioned in the patent application as being suitable for use in making the compositions thereof glutaric acid is not mentioned. Finally, The Chemical Formulary (Bennett) discloses, at p. 233, a gelled rust removing composition comprising Carbitol, nonylphenol ethoxylate, phosphoric acid, hydroxyacetic acid, methyl cellulose and water.

In none of the mentioned publications is a combination of glutaric acid and phosphoric acid mentioned in a liquid cleaner based on nonionic detergent and solvent of the types employed in the compositions of the present application. None of the mentioned publications, either alone or in combination with any others, describes or suggests the broadest inventive concept of this application and no such publication or combination thereof makes the invention or any aspect of it obvious to one of ordinary skill in the art.

In accordance with the present invention an acidic liquid detergent composition, suitable for cleaning ceramic tiles without eroding grout between them, comprises a minor proportion of glutaric acid, a lesser minor proportion of phosphoric acid, both acids being partially neutralized to a pH in the range of 3 to 5 and the detergent composition being at such pH, and the partially neutralized glutaric and phosphoric acids being present in such proportions that the proportion of partially neutralized glutaric acid in the composition is effective to remove soap scum from tiles and the proportion of partially neutralized phosphoric acid is effective to inhibit erosion of grout between the tiles by the partially neutralized glutaric acid, a minor proportion of a condensation product of ethylene oxide and higher linear alcohol of 8 to 20 carbon atoms, with the content of ethylene oxide being at least about 20 ethylene oxide groups per mole of the alcohol, which condensation product is effective in acid medium to lift soap scum off the tiles being cleaned, a minor proportion of a monolower alkyl ether or phenyl ether of diethylene glycol, wherein the lower alkyl is of 2 to 6 carbon atoms, with the proportion of such monoether of diethylene glycol being effective to assist in removing loosened soap scum from the tiles by helping to transport it away from the location where it was initially bonded to the tiles, and a major proportion of water, in which the partially neutralized glutaric acid, partially neutralized phosphoric acid, condensation product of ethylene oxide and linear alcohol, and diethylene glycol ether are dissolved.

While the acidic liquid detergent composition which includes both partially neutralized glutaric and phosphoric acids represents a much preferred aspect of the present invention, more broadly the invention may relate to such a detergent composition which comprises a minor proportion of a non-toxic and physiologically and aesthetically acceptable non-sequestering acid which reacts with calcium and magnesium soaps of higher fatty acids in the soap scum which is adherent to ceramic tiles and grout to be cleaned, so as to loosen the bond of such scum to such tiles, a lesser minor proportion of an acid which forms a water insoluble calcium salt, both acids being partially neutralized to a pH in the range of 3 to 5, a minor proportion of a detersive material, and a major proportion of water, and preferably also contains a minor proportion of a suitable water soluble organic solvent. In an aspect of the invention of intermediate scope the acidic detergent composition comprises a minor proportion of glutaric acid, as the physiologically and aesthetically acceptable non-sequestering acid, and the acid which forms a water insoluble calcium salt may be selected from the group consisting of phosphoric acid, tartaric acid, sulfuric acid, oxalic acid, tungstic acid, cumene sulfonic acid and higher linear alkyl benzene sulfonic acid wherein the higher alkyl is of 10 to 18, preferably 11 to 15 carbon atoms.

Also within the invention are methods for the manufacture of the described compositions, and methods for cleaning ceramic tiles and grout with such compositions.

Of all the organic acids which are of sufficient acidity effectively to attack soap scum and to convert it to a form which is readily removable from hard surfaces, such as ceramic tiles, Portland cement and acrylic latex grouts between the tiles, porcelain, porcelain enamel, glass, fiberglass and metal (such as chrome and nickel plated) surfaces, glutaric acid or a partially neutralized salt or ionized form thereof is highly preferred, because it performs effectively and has no significantly detrimental negative properties, but in some instances other acids capable of converting calcium and magnesium higher fatty acid soaps to acidic or partially neutralized form to assist in removing them from hard surfaces which they are staining (in the form of soap scum) may also be employed (when detrimental properties thereof, if any, are tolerable). Such acids will include those which do not form water insoluble calcium salts. For example, acetic acid, succinic acid, propionic acid and citric acid may be utilized in some circumstances. However, citric acid is a sequestering acid and tends to remove calcium from calcium carbonate in the grout employed between adjacent ceramic tiles, which is detrimental to its use, and the other mentioned acids are often unsatisfactory because of unacceptable odors and/or because they result in human nasal and/or respiratory irritation. Of course, those acids which are toxic under the circumstance of use will also preferably be avoided. Therefore, glutaric acid is preferably utilized as such soap scum attacking acid. It may be (and usually is) subsequently partially neutralized to the desired pH range during manufacture of the invented acidic cleaner but it is also within the invention to employ salts of such acid and to convert them to the desired pH, it being recognized that the products of both such operations are the same. Therefore, by reference to "partially neutralized glutaric acid" it is meant also to include such products resulting from partially acidifying glutaric acid salts (glutarates) or from directly incorporating the partially neutralized glutarates of desired pH with the other components of the cleaner.

Of the acids which form water insoluble calcium salts, and thereby apparently act to protect the calcium carbonate component of the grout against detrimental erosion, phosphoric acid (orthophosphoric acid) has been found to be highly acceptable. It is effective for making a product which meets all screening tests and such product is believed to be commercially acceptable. Phosphoric acid is found to diminish grout erosion more effectively than sulfuric acid, the salt of which is also water insoluble. However, other acids which also form water insoluble calcium salts, such as tartaric acid, oxalic acid, tungstic acid, cumene sulfonic acid and higher linear alkyl benzene sulfonic acids (preferably those wherein the higher alkyl is of 10 to 18 carbon atoms, more preferably of 11 to 15 carbon atoms) also form water insoluble calcium salts and sometimes may be more effective to inhibit grout erosion. Some such acids may not be sufficiently non-toxic to be employed in retail products for general use and others may be uneconomic, due to high manufacturing costs. Still others may be of limited stabilities in the described products. Nevertheless, in those circumstances when phosphorus-containing materials are to be avoided in detergent products, it may be desirable to substitute another of such acids (or others of equivalent performance) for the phosphoric acid.

While, in accordance with the broader aspects of the present invention, combinations of acids which react with calcium and magnesium soaps and those which form water insoluble (and non-soap) calcium salts may be employed with any suitable detergent solutions, including nonionic and anionic detergents and mixtures thereof, it will be highly preferable for the acidic liquid detergent compositions of this invention to comprise, as a detergent, a condensation product of ethylene oxide and higher linear alcohol of 8 to 20 carbon atoms, in which the content of ethylene oxide is at least 20 ethylene oxide groups per mole of the alcohol. In such nonionic detergents the higher linear alcohol will average the number of carbon atoms indicated and preferably such average will be from 9 to 18 carbon atoms, more preferably 9 to 15 carbon atoms, and most preferably 11 to 15 carbon atoms, e.g., about 13 carbon atoms per mole of the alkanol. Such alkanol will normally be a higher fatty alcohol, such as a primary or secondary monoalkanol (the secondary is preferred), and the fatty alcohol will be of a number of carbon atoms within the ranges given, averaging as indicated. The described nonionic surface active materials will include an average of at least about 20 ethylene oxide groups per mole of the alcohol, preferably from 20 to 100 moles, more preferably 20 to 60 moles, still more preferably 20 to 30 moles, and most preferably about 20 moles of ethylene oxide, on the average. Generally a major proportion of the ethylene oxide will be in chains of at least 10 moles of ethylene oxide and preferably substantially all (over 95%) will be in chains of at least 15 moles of ethylene oxide.

The acidic liquid detergent compositions of this invention will also normally comprise a mono-lower alkyl ether or a phenyl ether of diethylene glycol. The lower alkyl of such mono-lower alkyl ether of diethylene glycol will be of 2 to 6 carbon atoms and preferably will be normal butyl. Instead of the phenyl ether the benzyl ether may sometimes be desirably substituted, and mixtures of such ethers, including mixtures of the aromatic and aliphatic ethers, may also be employed. Normally, the corresponding monoethers of ethylene glycol will not be utilized, often because of problems of toxicities or poor performances, but in some circumstances they may be substitutable for the described monoethers of diethylene glycol, especially for the ethyl and hexyl ethers.

The water employed will desirably be deionized water, which usually will be of less than 20 parts per million of hardness (calcium and magnesium hardness equivalent to less than 20 parts of calcium carbonate per million). However, city waters may also be employed, even those of hardnesses of up to 300 p.p.m., although those of hardnesses below 150 p.p.m. and preferably below 50 or 100 p.p.m., will desirably be employed instead.

The acidic liquid detergent composition of this invention is normally in solution form, with the various components thereof being mutually soluble, so that settling out of one or more components does not occur on storage. The composition is also at a pH in a certain range for most effective cleaning of ceramic material and for minimal erosion of grout. At such a pH range, 3 to 5, preferably 3.5 to 4.5, more preferably 3.7 to 4.3, most preferably 3.9 to 4.1, e.g., about 4.0, mutual solubility, effective cleaning (removal of soap scum) and minimal grout erosion are obtainable.

The preferred composition of this invention includes partially neutralized glutaric and phosphoric acids, a condensation product of a linear secondary monoalkanol of an average of 11 to 15 carbon atoms, preferably about 13 carbon atoms, with an average of at least about 20 moles of ethylene oxide, preferably an average of 20 moles of ethylene oxide, and monobutyl ether of diethylene glycol (or phenyl ether of diethylene glycol) and water, but mixtures of such types of materials, with suitable equivalents substituted, as described herein, may also be employed, as may be mixtures of such equivalents, providing that the composition and use characteristics are acceptable.

The proportions of the various components of the invented compositions can determine the extent of effectiveness thereof and therefore such should be controlled for best performance of the product. It has been found that the desired cleaning effects are obtained without erosion of grout when the proportions of partially neutralized glutaric acid (calculated on the basis of the corresponding unnuetralized glutaric acid) and partially neutralized phosphoric acid (calculated on the basis of the corresponding unneutralized phosphoric acid), or other suitable acids, are in the ranges of 3 to 5% and 0.1 to 3%, respectively, preferably 3.5 to 4.5% and 0.5 to 2.5%, respectively, even more preferably 3.7 to 4.3% and 1.8 to 2.2%, respectively, and most preferably about 4 and 2%, respectively. In such compositions a minor proportion will be a detergent and a major proportion will be water, such proportions respectively being preferably 1 to 4% and 75 to 90%, more preferably 2 to 3% and 80 to 90%, and most preferably about 2.5% and about 85 to 88%. The detergent is preferably a nonionic detergent, and of such detergents the condensation products of ethylene oxide and higher secondary linear monoalkanol, previously described, are preferred. For best results the composition also includes a solvent which is a mono-lower alkyl ether or phenyl ether of diethylene glycol wherein the lower alkyl is of 2 to 6 carbon atoms. Proportions of such nonionic detergent and monoether of diethylene glycol, when both are employed, should be within the ranges of 1 to 4% and 2 to 5%, respectively, preferably 2 to 3% and 3.5 to 4.5%, and more preferably will be about 2.5% and about 4%, respectively. The adjuvant content of the composition will normally be limited to no more than about 5%, preferably to no more than 3% and most preferably to no more than about 1 or 2%, with the balance of the product normally being water, except for neutralizing agent.

In the compositions of this invention the described type and proportion of each component are considered important to the obtaining of a desired product, which is effective to clean ceramic tiles and other bathroom surfaces without eroding grout that will of necessity also be contacted by the detergent composition. Similarly, the pH is important for the obtaining of the desired effects. The proportion of acid for attacking the water insoluble calcium and magnesium fatty acid soaps, in the presence of the acid that forms an insoluble calcium salt, and at the mentioned pH, attacks the soap scum and renders it more readily removable by other components of the product. The acid which forms the insoluble calcium salt assists in maintaining the desired pH, helping to attack the soap scum, and at the same time it protects the grout, apparently by protecting the calcium carbonate, which is a major constituent of grouts, against attack by the other acidic component (partially neutralized acids are intended to be covered by this terminology). The nonionic surface active agent, at the pH described, has an improved detersive action and acts to promote lifting or release of the soap scum from the substrate to which it was previously strongly held. The diethylene glycol monoether, in the described medium, assists in removing the loosened soap scum from the ceramic (or ceramic tile) substrate by helping to transport it away from the location where it was initially bonded to the substrate. In other words, the monoether acts to float away the loosened or released and modified soap scum, allowing better access to the remaining held soap scum by the composition, thereby speeding the removal of the soap scum, for which it may also act as a solvent to an extent, The water, in the percentage present, acts as a mutual solvent for the other components, to produce the desired sprayable cleaning solution. Additionally, it acts as a medium which maintains the acids in effective ionized form and in contact with soap scum to facilitate reactions between the acids and the insoluble fatty acid soaps present. Of course, changes in the components of the present compositions and in the proportions thereof may be made which may still be within broader aspects of the invention but care should be exercised so that when such changes are effected the products resulting are still satisfactorily operative.

The compositions of this invention may be made by various methods, some of which have already been alluded to herein. Thus, it has been mentioned that salts of the described acids may be partially acidified to the desired pH, and this can be done in the presence or absence of other components of these compositions. However, it is preferred that the acidic components, e.g., glutaric and phosphoric acids, be mixed together with the nonionic detergent condensation product, the monoether of diethylene glycol and the water, and then be partially neutralized to the desired pH range by means of a suitable alkaline neutralizing agent. Of the alkaline neutralizing agents an aqueous solution of sodium hydroxide, such as a 50% solution thereof, is preferred, but other suitable neutralizing agents, such as potassium hydroxide and triethanolamine, may also be employed. Alternatively, the acids may be separately partially neutralized or may be partially neutralized together, in the presence of at least some of the water of the composition, and then may be further mixed with other components of the composition.

The various adjuvants which may be employed, including perfumes, colorants, such as dyes and pigments, thickeners, such as ethyl cellulose and various compatible organic gums, to modify spray patterns and decrease flow rates of the products along vertical surfaces, bleaches, antibacterial and antifungal compounds, emollients, rust removers and polishing agents (in some cases), usually are preferably post-added to the product of desired acidity (with allowance being made for the effects of the adjuvants), but also may be incorporated in the mixture of other constituents before partial neutralization of the acids thereof.

In use, the compositions of this invention are applied to the surfaces to be cleaned (and the compositions are useful for cleaning other soils than soap scum), preferably by spraying onto ceramic or other surfaces which have been soiled by accumulations of insoluble soaps. The cleaning compositions, without thickener, are of about the viscosity of water (and often are thinner) and so are preferably applied as fine sprays to avoid excessive dripping down vertical surfaces. The material will usually be allowed to remain on the surface to be cleaned for a period from 10 seconds to 5 or 10 minutes, but preferably such contact time will be from about 30 seconds to five minutes or from 1 to 3 minutes. The acidic detergent composition may then be removed by rinsing with a water spray. Preferably, before such rinsing, it will be wiped off, as with a cloth or sponge, and sometimes the surface to be cleaned may have the cleaner brushed into vigorous contact with it. It has been found that such wiping (and/or brushing) and the application of the relatively small amount of mechanical energy so imparted helps to remove the soap scum, especially if such has been applied from numerous applications or splashings onto the ceramic surfaces of soapy hard water without any previous cleaning applications of an acidic detergent composition like that of this invention. The ceramic surfaces, such as tiles, which are cleaned by the described method, are found to be shiny and lustrous, looking almost like new, and microscopic examinations of the grout between such tile surfaces shows little erosion or other deterioration, compared to "control" cleaning compositions which do not employ the described mixtures of partially neutralized acids. Cleanings of the tiles are effected easily and the invented compositions are safter to use, compared with other acidic liquid detergent compositions for this purpose (which are harmful to the grout). With regular use of the invented compositions brushing of the acidic detergent onto the surfaces to be cleaned, and wiping or rubbing with a cloth or sponge may often be omitted, and only spraying on of the composition and rinsing it off may be required steps of the cleaning method. In addition to inhibiting grout erosion it has been noted that the present compositions are also useful in cleaning metal ware, such as nickel- and chrome-plated base metals and copper, without significant solubilizations of such metals.

The following examples illustrate but do not limit the invention. Unless otherwise indicated all temperatures are in °C. and all parts are by weight.

EXAMPLE 1

| Component | Percent |
|---|---|
| Glutaric acid | 4.0 |
| Phosphoric acid | 2.0 |
| $C_{11}$-$C_{15}$ linear secondary alkanol ethoxylate containing an average of about 20 moles of ethylene oxide per mole of alkanol (Tergitol ® 15-S-20 nonionic detergent, marketed by Union Carbide Corporation) | 2.5 |
| Diethylene glycol monobutyl ether (butyl Carbitol ®, marketed by Union Carbide Corporation) | 4.0 |
| 50% Aqueous sodium hydroxide solution | 2.6 |
| Perfume | QS (not to exceed 3.0) |
| Deionized water | Balance |
| | 100.00 |

The above acidic liquid detergent composition is made by mixing together the various components to produce a solution which has a buffered pH of 4.0. When the desired proportion of neutralizing agent to produce such pH or other desired pH within the range of 3 to 5 is not known on the basis of previous experiments, the glutaric acid, phosphoric acid, nonionic detergent, monoether of diethylene glycol and water are mixed together, after which sodium hydroxide solution (or other suitable neutralizing agent, such as aqueous KOH or triethanolamine) is admixed, with pH monitoring, until the desired pH is reached. Then the perfume, which is stable in acidic media, will also be added. The manufacturing method is extremely simple and orders of addition are not usually significant or critical (except that the neutralizing agent will often best be added last to allow for best pH control and to promote rapid attainment of equilibrium).

The product made is a clear, pleasant smelling water white liquid, suitable for spraying onto surfaces to be cleaned, without excessive foaming. It is of a viscosity approximately that of water or slightly less, but satisfactorily covers and holds to vertical surfaces without excessive dripping when applied in an economical thin, yet effective, "coating" onto surfaces to the cleaned. Application onto such surfaces is by spraying, with the spray nozzle being at a distance of about 15 to 20 cm. from the surface to be cleaned. After spraying onto the surface and allowing the liquid cleaner to remain thereon for about one minute or less the surface is wiped with a cloth or sponge, after which it is rinsed thoroughly. In those cases when the surface being cleaned is slippery after completion of one such cleaning operation (indicating that not all the soap scum has been removed), the operation is repeated and in such repeated operation, which is the treatment for heavy buildups of soap scum on surfaces to be cleaned, the product will be allowed to stay on the surface to be cleaned for a few minutes, e.g., 3 to 5 minutes, before wiping. The end result of following such cleaning method is the production of a "squeaky clean" surface which sparkles and is lustrous "like new". In repeated applications after light soilings with soap scum the wiping step may sometimes be omitted (and is omitted) and the surface being cleaned, whether porcelain or porcelain enamelware, as in a sink or tub, or ceramic tile, such as on bathroom walls or floors, or of shower stalls, tub enclosures or other such hard bathroom surfaces, will be cleaned of the hard to remove soap scum and will be attractively lustrous, without the need for wiping prior to rinsing off of the acidic cleaner. The cleaner may be applied in similar fashion to glassware and fiberglass panels, such as those in shower doors or tub enclosures, and onto nickel- or chrome-plated faucets, handles and spouts and onto copper and brass parts, which are also satisfactorily cleaned of soap scum buildups without damage to the materials thereof. Especially with respect to metal parts this is an important advantage of the present invention because platings are not worn through after repeated uses and base metals are not exposed.

In modifications of this example the proportion of glutaric acid is varied to 3.5% and to 4.5%, the proportion of phosphoric acid is varied to 0.2% and 2.5%, the proportion of the nonionic detergent condensation product is varied to 1.5% and 3.5%, the proportion of monoether of diethylene glycol is varied to 3% and 5%, the perfume is omitted and the proportion of deionized water is the balance, respectively, for such compositions. The cleaners so made, like the cleaner of the first formula given, when brought to a pH of 3.5 to 4.5, are effective for removing soap scum from ceramic tiles and other bathroom surfaces and do not erode the grout between the tiles, whether it is of latex or Portland cement type, even after repeated applications of the cleaner (more than 40). When the pH is lowered to less than 3 the grout shows erosion and when the pH is greater than 5 cleaning tends to be inadequate.

When the phosphoric acid is omitted from the mentioned alternative formulas or is replaced by an equivalent proportion of glutaric acid grout erosion is noted after repeated uses of such "controls" on grout between experimental panels of nine tiles each.

When the glutaric acid of the main three formulas given in this example is replaced by citric acid (control) grout damage is noted, apparently due to the calcium sequestering effect of such acid. Also, when acetic acid, succinic acid and propionic acid or mixtures thereof are employed in place of the glutaric acid the products made are objectionable because they have unacceptable odors and cause nasal and respiratory irritations due to the presence(s) of such acid(s).

EXAMPLE 2

The experimental formulas of Example 1 that are within the invention are modified by replacing the phosphoric acid thereof with one of the following: sulfuric acid, tartaric acid, oxalic acid, cumene sulfonic acid, linear tridecylbenzene sulfonic acid and tungstic acid. The cleaning solutions made are neutralized to a pH of 4. Alternatively, the corresponding salts may be employed, as may be mixtures of the acids and/or salts. When the salts are used the solution may be brought to the desired pH by addition of the corresponding acids or of suitable compatible acidifying agents. Mixtures of the acids, mixtures of the salts and mixtures of acids and salts may also be employed. The products made, when tested in the manner previously described or when tested by soaking experimental ceramic tile panels repeatedly with intermediate latex or Portland cement grout between them for five minutes in the test cleaning solution, followed by wiping and rinsing, show improved stability of the grout, compared to "control" solutions wherein such acids (which form insoluble calcium salts) are not present, being replaced by glutaric acid.

When a suitable thickener is added to the formulas of this example or to the formulas of Example 1 a product will be made which flows less readily down a vertical wall onto which it has been sprayed. Such a thickener is about 0.1 to 1% of methyl cellulose or hydroxypropyl methyl cellulose. Bentonite clays, magnesium aluminosilicate, colloidal silicas, organic gums and synthetic organic polymers may also be used but care will be taken to ensure that with the thickener employed the composition will not settle out and the product will spray satisfactorily.

EXAMPLE 3

The experiments of Examples 1 and 2 are repeated, with the nonionic detergent condensation product being replaced with similar condensation products wherein the fatty alcohol is a primary or secondary alcohol or mixture thereof of an average of 12, 14 or 16 carbon atoms, and the number of ethylene oxide groups per mole is 20, 30 or 40, respectively. Results obtained are like those previously described for the invented cleaners. Similarly, when the monoether of diethylene glycol is the phenyl ether, the ethyl ether or the n-hexyl ether, similar results are obtained. When such monoether is of ethylene glycol instead, useful cleaning is obtainable but such compositions are less desirable because of the possible toxicity thereof due to the presence of the ethylene glycol ether(s). Also, when other detergents are employed with the desired mixtures of partially neutralized acids, such as sodium linear alkyl benzene sulfonate and other stable anionic detergents, or other nonionic detergents, e.g., Pluronics ®, with or without the mentioned nonionic detergent condensation product and the diethylene glycol ether, useful cleaning is obtainable without damage to the grout, but such cleaning is not as efficient or effective as may be obtained with the preferred cleaning compositions described.

EXAMPLE 4

In the previous examples the proportions of the mentioned components are varied ±10%, ±20% and ±30%, and the pH is also changed to such extents, while remaining within the ranges specified, and the cleaning compositions made are effective to remove soap scums from hard surfaces without eroding grout between such surfaces. Such results are visually apparent after multiple treatments and are verifiable when the grout surfaces are viewed under magnification. In some instances the control grouts do not show visible effects of erosion but measurements of the grout thicknesses show that such controls have worn away more than the "experimental" formulas of this invention to which they are compared.

From the above examples and the preceding specification it is evident that the present invention provides attractive, convenient, economical, effective and efficient means for removing soap scum from bathroom surfaces. The result obtained is largely due to the utilization of different types of acids mentioned, one to soften the deposit of water insoluble soap and the other to prevent damage to the grout. The grout protection feature is considered to be most surprising and beneficial. Also important components of the invented products are the condensation product and the diethylene glycol ether, which promote removal of the soap scum from the substrate. While other cleaners are capable of removing water insoluble soaps from bathroom surfaces they do not do so as effectively and at a comparatively high acidic pH, and do not protect grout between ceramic tiles. Therefore, use of such cleaners eventually leads to deterioration of the grout and the tile wall or floor. The present cleaners, in addition to being useful for cleaning ceramic tiles and intermediate grout, may also be employed to clean various other ceramic, synthetic organic polymeric plastic and metal surfaces, including glass, fiberglass and chrome-plated metal, and do not harm such surfaces or associated grout. The invented product is comparatively mild to the hands, is easy to employ and consistently yields excellent results. Accordingly, it represents a significant advance in the tile cleaner art.

The invention has been described with respect to illustrations and working examples thereof but is not to be limited to these because it is evident that one of skill in the art to which this invention pertains, with the present application before him, will be able to utilize substitutes and equivalents without departing from the invention.

What is claimed is:

1. An acidic liquid detergent composition, suitable for cleaning ceramic tiles without eroding grout between them, which comprises a minor proportion of glutaric acid, a lesser minor proportion of phosphoric acid, both acids being partially neutralized to a pH in the range of 3 to 5 and the detergent composition being at such pH, and the partially neutralized glutaric and phosphoric acids being present in such proportions that the proportion of partially neutralized glutaric acid in the composition is effective to remove soap scum from tiles and the proportion of partially neutralized phosphoric acid is effective to inhibit erosion of grout between the tiles by the partially neutralized glutaric acid, a minor proportion of a condensation product of ethylene oxide and higher linear alcohol of 8 to 20 carbon atoms, with the content of ethylene oxide being at least about 20 ethylene oxide groups per mole of the alcohol, which condensation product is effective in acid medium to lift soap scum off the tiles being cleaned, a minor proportion of a mono-lower alkyl ether or phenyl ether of diethylene glycol, wherein the lower alkyl is of 2 to 6 carbon atoms, with the proportion of such monoether of diethylene glycol being effective to assist in removing loosened soap scum from the tiles by helping to transport it away from the location where it was initially bonded to the tiles, and a major proportion of water, in which the partially neutralized glutaric acid, partially neutralized phosphoric acid, condensation product of ethylene oxide and linear alcohol, and diethylene glycol ether are dissolved.

2. A detergent composition according to claim 1 wherein the partially neutralized glutaric and phosphoric acids are sodium salts, the condensation product of ethylene oxide and linear alcohol is a condensation product of 20 to 60 moles of ethylene oxide with a secondary monoalkanol of 9 to 18 carbon atoms, the monoether of diethylene glycol is the monobutyl ether and the proportion of water is at least 70%.

3. A detergent composition according to claim 2 which is at a pH in the range of 3.5 to 4.5, in which the condensation product is of a linear secondary monoalkanol of about 9 to 15 carbon atoms with about 20 to 30 moles of ethylene oxide, and in which the weight proportions of partially neutralized glutaric acid, partially neutralized phosphoric acid, condensation product of ethylene oxide and higher secondary linear monoalkanol, monobutyl ether of diethylene glycol and water are in the ranges of 3 to 5%, 0.1 to 3%, 1 to 4%, 2 to 5% and 75 to 90% respectively.

4. A detergent composition according to claim 3 which comprises, by weight, 3.5 to 4.5% of partially neutralized glutaric acid, 0.5 to 2.5% of partially neutralized phosphoric acid, 2 to 3% of condensation product of ethylene oxide and linear secondary monoalkanol, 3.5 to 4.5% of the monobutyl ether of diethylene glycol and 80 to 90% of deionized water, and of which the pH is in the range of 3.9 to 4.1.

5. A detergent composition according to claim 4 which is at a pH of about 4.0 and comprises by weight about 4% of partially neutralized glutaric acid, about 2% of partially neutralized phosphoric acid, about 2.5% of the condensation product of a linear secondary monoalkanol of about 11 to 15 carbon atoms with about 20 moles of ethylene oxide, about 4% of the monobutyl ether of diethylene glycol, no more than about 5% of adjuvants, and the balance of water.

6. An acidic liquid detergent composition suitable for cleaning ceramic tiles without eroding grout between them which comprises a major proportion of water, a minor proportion of glutaric acid and a lesser minor proportion of an acid which forms a water insoluble calcium salt selected from the group consisting of phosphoric acid, tartaric acid, sulfuric acid, oxalic acid, tungstic acid, cumene sulfonic acid and linear $C_{10}$–$C_{18}$ alkyl benzene sulfonic acid, both acids being partially neutralized to a pH of 3 to 5 and said detergent composition being of such pH, the partially neutralized glutaric acid and the partially neutralized other such acid being present in such proportions that the partially neutralized glutaric acid in the composition is effective to remove soap scum from the tiles and the partially neutralized other acid is effective to inhibit erosion of grout between the tiles by the partially neutralized glutaric acid.

7. A composition according to claim 6 wherein said composition contains, in addition, a minor proportion of a detergent selected from the group consisting of anionic detergents, nonionic detergents and mixtures thereof.

8. A composition according to claim 6 which is at a pH in the range of 3.5 to 4.5 and comprises a minor proportion of glutaric acid, a lesser minor proportion of said other acid, which forms a water insoluble calcium salt, both acids being partially neutralized to a pH in the range of 3.5 to 4.5, and in which the partially neutralized glutaric and said other acid are present in such proportions that the partially neutralized glutaric acid in the composition is effective to remove soap scum from the tiles and the partially neutralized said other acid is effective to inhibit erosion of grout between the tiles by the partially neutralized glutaric acid, a minor proportion of a condensation product of ethylene oxide and higher linear alchol of 8 to 20 carbon atoms, with the content of ethylene oxide averaging at least about 20 ethylene oxide groups per mole of the alcohol, which condensation product is effective in an acid medium to lift soap scum off the tiles being cleaned, a minor proportion of mono-lower alkyl ether or phenyl ether of diethylene glycol, wherein the lower alkyl is of 2 to 6 carbon atoms, with the proportion of such monoether of diethylene glycol being effective to assist in removing loosened soap scum from the tiles by helping to transport it away from a location where it was initially bonded to the tiles, and a major proportion of water, in which the partially neutralized glutaric acid, partially neutralized said other acid, condensation product of linear alcohol, and diethylene glycol ether are dissolved.

9. A method of making an acidic liquid detergent composition, suitable for cleaning ceramic tiles without eroding grout between them, which comprises mixing together minor proportions of glutaric acid, phosphoric acid, a condensation product of ethylene oxide and higher linear alcohol of 8 to 20 carbon atoms, with the content of ethylene oxide being at least about 20 ethylene oxide groups per mole of the alcohol, and mono-lower alkyl ether or phenyl ether of diethylene glycol, wherein the lower alkyl is of 2 to 6 carbon atoms, and a major proportion of water, with the proportion of phosphoric acid being less than that of glutaric acid, and partially neutralizing the glutaric acid and the phosphoric acid by addition to the mixture of an aqueous solution of a neutralizing agent, until the pH is in the range of 3.5 to 4.5, with the proportions of the glutaric acid, phosphoric acid, condensation product, diethylene glycol ether and water being such that the partially neutralized glutaric acid is effective to remove soap scum from tile walls, the partially neutralized phosphoric acid is effective to inhibit erosion of grout between the tiles of such walls by the partially neutralized glutaric acid, the condensation product is effective, in acid medium, to lift soap scum off the tiles being cleaned, the diethylene glycol ether is effective to assist in removing loosened soap scum from the tiles by helping to transport it away from the location where it was initially bonded to the tiles, and the water is effective to dissolve the other components of the composition.

10. A method according to claim 9 wherein the acidic liquid detergent composition comprises by weight about 4% of partially neutralized glutaric acid, about 2% of partially neutralized phosphoric acid, about 2.5% of the condensation product of a linear secondary monoalkanol of about 11 to 15 carbon atoms with about 20 moles of ethylene oxide, about 4% of monobutyl ether of diethylene glycol, no more than about 5% of adjuvants, and the balance of water, and the partial neutralizing of the glutaric acid and the phosphoric acid is effected by addition of aqueous sodium hydroxide to the mixture of glutaric acid, phosphoric acid, condensation product, diethylene glycol ether and water until the pH of the composition is about 4.0.

11. A method for removing water insoluble soap scum from ceramic tiles which have grout between them without eroding the grout which comprises applying to such tiles and grout an acidic liquid detergent composition which comprises a major proportion of water, a minor proportion of glutaric acid, a lesser minor proportion of an acid which forms a water insoluble calcium salt selected from the group consisting of phosphoric acid, tartaric acid, sulfuric acid, oxalic acid, tungstic acid, cumene sulfonic acid and linear $C_{10}$–$C_{18}$ alkyl benzene sulfonic acid, both acids being partially neutralized to a pH in the range of 3 to 5 and the detergent composition being at such pH, the partially neutralized glutaric acid in the composition being effective to remove the soap scum from the tiles and the other partially neutralized acid being effective to inhibit erosion of grout between the tiles by the partially neutralized glutaric acid; and rinsing the detergent composition from the tiles and the grout.

12. A method according to claim 11 wherein said acidic liquid detergent composition contains, in addition, a minor proportion of a detergent selected from the group consisting of anionic detergents, nonionic detergents and mixtures thereof.

13. A method according to claim 9 wherein said glutaric acid and phosphoric acid are mixed in the presence of at least some of the water, said aqueous solution of neutralizing agent is added thereto with agitation and said condensation product and said diethylene glycol ether are added thereafter with agitation.

14. A method according to claim 11 wherein the acidic detergent composition employed is at a pH in the range of 3.5 to 4.5 and comprises a minor proportion of glutaric acid, a lesser minor proportion of said other acid, which forms a water insoluble calcium salt, both acids being partially neutralized to a pH in the range of 3.5 to 4.5, and the partially neutralized glutaric and said other acid being present in such proportions that the partially neutralized glutaric acid in the composition is effective to remove soap scum from tiles and the partially neutralized said other acid is effective to inhibit erosion of grout between the tiles by the partially neutralized glutaric acid, a minor proportion of a condensation product of ethylene oxide and higher linear alcohol of 8 to 20 carbon atoms, with the content of ethylene oxide being at least about 20 ethylene oxide groups per mole of the alcohol, which condensation product is effective in an acid medium to lift soap scum off the tiles being cleaned, a minor proportion of mono-lower alkyl ether or phenyl ether of diethylene glycol, wherein the lower alkyl is of 2 to 6 carbon atoms, with the proportion of such monoether of diethylene glycol being effective to assist in removing loosened soap scum from the tiles by helping to transport it away from the location where it was initially bonded to the tiles, and a major proportion of water, in which the partially neutralized glutaric acid, partially neutralized said other acid, condensation product of linear alcohol, and diethylene glycol ether are dissolved, the tiles and grout are wiped to remove the acidic liquid detergent composition from them and the tiles and grout are rinsed with water after such wiping.

* * * * *